United States Patent [19]

Casalis et al.

[11] 4,113,624

[45] Sep. 12, 1978

[54] FLOTATION APPARATUS WITH MECHANICAL AGITATION

[75] Inventors: Jean-Arnaud Casalis, Mareil-Marly; Yves Teil, Sevres; Raymond Motte, Houilles, all of France

[73] Assignee: Societe Miniere et Metallurgique de Penarroya, Paris, France

[21] Appl. No.: 713,371

[22] Filed: Aug. 11, 1976

[30] Foreign Application Priority Data

Aug. 14, 1975 [FR] France ..... 75 25429

[51] Int. Cl.[2] ..... B01F 3/04

[52] U.S. Cl. ..... 210/219; 209/169; 210/221 M; 261/87

[58] Field of Search ..... 209/169; 210/44, 221 M, 210/219, 221 P; 261/87, 93, 123

[56] References Cited

U.S. PATENT DOCUMENTS

| | | | |
|---|---|---|---|
| 2,308,751 | 1/1943 | Guthrie et al. | 261/87 |
| 2,944,802 | 7/1960 | Daman | 261/87 |
| 3,067,988 | 12/1962 | Rodoz | 210/221 M |
| 3,752,313 | 8/1973 | Watin | 261/87 |

*Primary Examiner*—Charles N. Hart
*Assistant Examiner*—Peter A. Hruskoci
*Attorney, Agent, or Firm*—Fleit & Jacobson

[57] ABSTRACT

An agitator for use in flotation having a frusto-conical skirt attached to a central hub to the agitator. The agitator also having two layers of bars disposed symmetrically on the generatrices of two opposite, coaxial truncated cones mounted at their ends on circular bases, at least one base being perforated to allow passage of flotation medium, and the bases being connected by a hollow central hub of which an upper portion is adapted to receive pressurized gas and a lower portion is provided with at least one orifice for discharging the gas. The frusto-conical skirt is situated between the bars and the central hub, is coaxial with the hub and is attached at its upper end to the hub.

9 Claims, 1 Drawing Figure

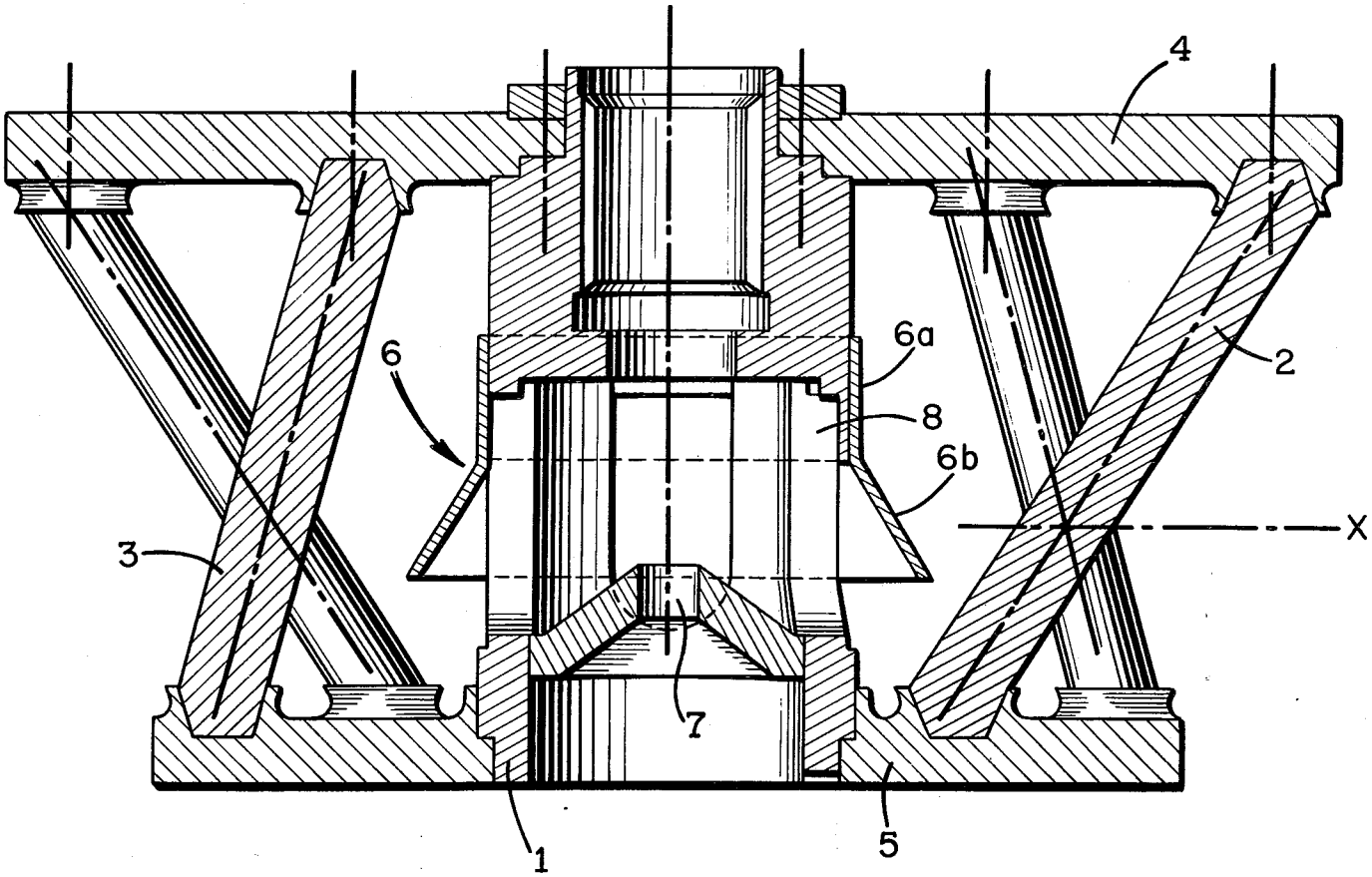
X
2
4
6a
8
6b
5
7
1
6
3

FLOTATION APPARATUS WITH MECHANICAL AGITATION

The invention relates to an improved agitator for use in flotation.

Flotation is a well-known method of separating finely crushed particles and is used extensively for concentrating ores, coal sludge and other minerals. It is carried out in tanks, in which the pulp, that is, a mixture of water and the substance to be processed, generally with the addition of a foaming agent and various other substances, is supplied to the tank bottom.

For many years, this process was carried out in a static fashion by passing gas through the flotation tanks so that the gas bubbles traversing the pulp collected the mineral particles and carried them to the surface, where the foam could be skimmed off. The yield of this operation was generally poor, due to the inadequate distribution of the reagents and gas through the vessels and owing to sedimentation of the pulp, which occurred because the passage of the gas did not sufficiently agitate the pulp.

The process was subsequently improved by means of mechanical agitation which aerated the pulp by cavitation. In spite of the increase in processing costs due to mechanical wear on the agitators and the high power consumption required, the yields obtained under these conditions are such that this dynamic flotation has been almost universally adopted.

Various types of mechanical agitators for this process have been described and used. Of these, one of the most satisfactory is described in our French Pat. No. 1,200,365, published in 1959. This French patent corresponds to U.S. Pat. No. 3,067,988. In one advantageous embodiment thereof, it is formed by two layers of bars which are disposed in regular fashion (symmetrically) on the generatrices of two opposite, coaxial truncated cones; at their ends the bars are mounted on circular bases of which at least one contains holes to allow circulation of the pulp being processed. In this apparatus the gas required for flotation is injected into the upper portion of a hollow axial hub, which connects the circular bases and whose lower portion contains outlets through which the gas escapes to the pulp during processing; the outlets are a central orifice in the base of the hub and vertical slots, or "ports", in its lateral surface.

An object of the invention is to provide an improvement over apparatus of this type, so as to increase its efficiency but not its power consumption, and which can readily be constructed using the flotation agitator described above.

According to the invention a flotation agitator with crossed bars, of the type described above, also comprises a solid, downwardly open, frusto-conical skirt which is situated between the bars and the central hub, is coaxial with the hub and is mounted at its upper (narrower) end to the hub.

Preferably, the frusto-conical skirt is extended upwards at its narrower end by a cylindrical sleeve, which latter is attached to the central axis of the agitator. Advantageously, moreover, the frusto-conical skirt and the cylindrical sleeve which extends it upwards are made in one piece.

For simplicity's sake, the assembly formed by the frusto-conical skirt and cylindrical sleeve will often be referred to hereinafter as the "air deflector cone" (which term is explained below).

The dimensions of this air deflector cone and its position relative to the crossed-bar agitator depend to a large extent on the dimensions of the agitator and on the nature of the pulp to be processed. However, it is an advantage if the bottom of the air deflector cone is below the zone in which the two layers of bars intersect.

The bottom of the air deflector cone is preferably above the ports formed in the central hub of the crossbar agitator. Advantageously, also, the bottom of the cone is at a level close to the lowest orifice in the central hub.

Those skilled in the art will find it easy to determine the values to be given various parameters in each particular case, by reference to the ensuing description.

The invention will be further described in conjunction with the accompanying drawing, the single FIGURE of which represents an axial section through an agitator according to the invention.

Referring to the drawing, the agitator comprises a central hub 1 and two layers of bars 2, 3 arranged on the generatrices of two opposite, coaxial truncated cones. At their ends the bars are mounted on circular bases, the upper base being designated 4 in the FIGURE and the lower base 5. The base 4 is solid, whereas the base 5 contains holes (not shown) to enable the pulp processed to circulate.

The central hub 1 is provided at its upper end with means (not shown) for supplying it with air under pressure. At its lower end it contains an axial orifice 7 through which air escapes. In addition, its lateral surface contains four ports 8 through which some of the air injected can also escape.

The ports are vertical slots, of which the uppermost ends are approximately halfway up the hub 1. The height of the slots may be adjustable, at least in experimental apparatus.

The agitation apparatus just described substantially corresponds to a version disclosed in the above-mentioned French Pat. No. 1,200,365. The flotation agitator according to the present invention differs from this essentially in the addition of an air deflector, generally designated 6 in the accompanying FIGURE.

The deflector 6 is preferably made in one piece and consists essentially of a cylindrical upper portion **6*a* mounted on the central hub 1 and extended downwards by a frusto-conical portion 6*b* flaring towards the lower base 5** of the apparatus.

The following numerical example will make it easy for those skilled in the art to decide what dimensions to adopt for optimum results. First, however, it may be stated that it is advantageous to adopt, at least approximately, a design such that the lower edge of the frusto-conical portion **6*b* of the deflector 6** is at a vertical level which is:

(a) below the plane X of intersection of the two layers of bars 2, 3;

(b) below the uppermost points of the slots 8 in the central hub 1; and (c) close to that of the axial orifice 7 in the central hub 1.

The agitator used in this example is a crossed-bar agitator similar to that described in the above-mentioned French patent specification and with substantially the same proportions as those indicated in the accompanying drawing, its external diameter being 440 mm and the diameter of its central hub 1 being 120 mm.

The agitator is immersed in a flotation vessel of capacity 1 $m^3$ and is driven by an electric motor at the rate of 315 rev/min, corresponding to a peripheral speed of 7.5 m/sec. at the upper base 4.

The central hub 1 of the agitator is connected by its upper portion to a compressor of air provided with a pressure-reducer for which the upstream pressure is 5.5 bars and the downstream pressure 0.1 bar, the air flow rate supplied to the agitator being measured by means of a flow meter graduated to give readings of 500 to 2000 l/min.

On this agitator, which will hereinafter be termed the "original agitator", is mounted an air deflector according to the invention, the dimensions of which are given in the following table.

DIMENSIONS OF DEFLECTOR 6

(A) CYLINDRICAL PORTION *6a*
- Internal diameter: 120 mm
- Height below top of ports 8: 30 mm
- Height above top of ports 8: as desired, e.g. 15 mm (B) FRUSTO-CONICAL PORTION *6b*
- Diameter at bottom: 170 mm
- Height: 40 mm
- Angle at vertex of truncated cone: 60°
- Distance from bottom to bottom of adjacent ports 8: 20 mm
- Distance from bottom to plane X: 20 mm To illustrate the superiority of an agitator according to the invention over the original agitator, the two agitators are subjected to various tests which will now be described.

A first series of experiments measured the power consumed by rotating the two types of apparatus under various operating conditions: firstly, with the flotation cell empty, then with the cell full but without any air being injected, and finally with the cell full and the compressed air required for flotation being admitted to the central hub of the agitator at various rates between 500 and 2000 liters per minute.

The results obtained are reproduced in the following Table.

| Cell | Air flow rates (l/min) | Power consumption (Wh) | |
|---|---|---|---|
| | | Original agitator | Agitator embodying invention |
| Empty | — | 560 | 560 |
| Full | 0 | 2145 | 2150 |
| " | 500 | 1475 | 1510 |
| " | 800 | 1360 | 1375 |
| " | 1100 | 1225 | — |
| " | 1200 | — | 1230 |
| " | 1500 | 1180 | 1210 |
| " | 2000 | 1135 | 1130 |

This Table makes is abundantly clear that the agitator of the invention consumes no more power than the original agitator. The importance of this will be appreciated by those skilled in the art, since they know that the power consumption of the agitators is a large item in the cost of processing substances subjected to flotation.

Moreover, another advantage provided by the invention is shown clearly by a second series of experiments, which determined what rate of air injection into the agitator corresponds to the dispersion limit of the pulp processed. (This value can be gauged with great accuracy by eye, merely by observing the flotation cell, for when the dispersion limit of the pulp is reached "fountains" or eddies appear on the surface of the water near the periphery of the agitation mechanism.)

Under experimental conditions it was found that the dispersion limit, reached at a flow rate of 1000 l/min with the original agitator, rises to 2000 l/min in the case of an agitator of the invention.

This result is surprising and completely unexpected; i.e. the fact that the mere addition of the air deflector of the invention doubles the dispersion limit of the original agitator, without (it must be emphasized) increasing the power consumption, and no theory can explain it satisfactorily.

The embodiment just described gives optimum operation for a given form of agitator and a certain quantity of pulp to be processed. Nevertheless, the numerical values given above for the various parameters of the apparatus are not critical; to demonstrate this, various tests were carried out, in which the following parameters were varied:

$a$ = total height of ports 8;
$b$ = diameter of axial orifice 7;
$c$ = distance between bottom of air deflector 6 and bottom of ports 8;
$d$ = pressure of air injected.

In each of the tests, which were carried out under the same experimental conditions as above, the dispersion limit was determined by eye in the manner described above. The results of these tests are given in the following Table:

| Test No. | a(mm) | b(mm) | c(mm) | d(cm of water) | Dispersion limit (l/mn) |
|---|---|---|---|---|---|
| 1 | 80 | 20 | 20 | 90 | 2000 |
| 2 | 100 | 26 | 35 | 95 | 2000 |
| 3 | 100 | 26 | 40 | 80 | 1800 |
| 4 | 100 | 26 | 30 | 85 | 1900 |

It will be noted that the results obtained in Tests Nos. 2 to 4 are equal or almost equal to those of Test No. 1, which corresponds to the example given above.

It is clear from this that the values to be adopted for the various measurements are far from critical and numerous other tests have confirmed this conclusion. Those skilled in the art can easily adjust the dimensions of the apparatus to meet the particular flotation purpose desired.

What we claim is:

1. A flotation apparatus comprising a tank for holding a body of pulp, an agitator rotatable in said tank, means for rotating said agitator, and means for flowing pressurized gas into the pulp along an axis of said agitator, said agitator comprising two layers of bars which are disposed symmetrically on the generatrices of two opposite, coaxial truncated cones and which are mounted at their ends on circular bases, at least one base being perforated to allow passage of flotation medium and the bases being connected by a hollow central hub of which the upper portion is adapted to receive pressurized gas and the lower portion is provided with at least one orifice for discharging the gas, which agitator also includes a solid, downwardly open, frustoconical skirt which is situated between the bars and the central hub, is coaxial with the hub and is attached at its upper end to the hub.

2. A flotation apparatus as claimed in claim 1, wherein the frusto-conical skirt is extended upwards by a cylindrical sleeve attached to the central hub.

3. A flotation apparatus as claimed in claim 2, wherein the cylindrical sleeve at least partly surrounds the central hub, to which it is directly attached.

4. A flotation apparatus as claimed in claim 2, wherein the frusto-conical skirt and cylindrical sleeve are made in one piece.

5. A flotation apparatus as claimed in claim 1, wherein the bottom of the frusto-conical skirt is below the zone in which the layers of bars intersect.

6. A flotation apparatus as claimed in claim 1, wherein the central hub comprises, in the lower part of its lateral surface, ports for discharge of the gas.

7. A flotation apparatus as claimed in claim 6, wherein the bottom of the frusto-conical skirt is above the lowest points of the ports.

8. A flotation apparatus as claimed in claim 1, wherein the central hub comprises an axial orifice in its lower portion, for discharge of the gas.

9. A flotation apparatus as claimed in claim 8, wherein the bottom of the frusto-conical skirt is substantially level with the axial orifice.

* * * * *